US007910878B2

(12) United States Patent
Bowdler

(10) Patent No.: US 7,910,878 B2
(45) Date of Patent: Mar. 22, 2011

(54) METHOD AND APPARATUS FOR ION AXIAL SPATIAL DISTRIBUTION FOCUSING

(75) Inventor: Andrew Bowdler, Staffordshire (GB)

(73) Assignee: Kratos Analytical Limited, Manchester (GB)

( * ) Notice: Subject to any disclaimer, the term of this patent is extended or adjusted under 35 U.S.C. 154(b) by 0 days.

(21) Appl. No.: 12/506,605

(22) Filed: Jul. 21, 2009

(65) Prior Publication Data

US 2010/0065738 A1 Mar. 18, 2010

Related U.S. Application Data

(60) Provisional application No. 61/129,879, filed on Jul. 25, 2008.

(30) Foreign Application Priority Data

Jul. 25, 2008 (GB) ..... 0813725.9

(51) Int. Cl.
*H01J 49/26* (2006.01)

(52) U.S. Cl. ..... 250/283; 250/281; 250/282

(58) Field of Classification Search ..... 250/281, 250/282, 287, 288, 283, 284, 286, 290, 291, 250/292, 294, 295, 296
See application file for complete search history.

(56) References Cited

U.S. PATENT DOCUMENTS 5,464,985 A 11/1995 Cornish et al.
5,654,545 A 8/1997 Holle et al.
5,739,529 A 4/1998 Laukien et al.
2002/0027194 A1 3/2002 Holle et al.
2002/0070339 A1 * 6/2002 Clemmer ..... 250/299
2002/0096630 A1 * 7/2002 Russ, IV ..... 250/283

(Continued)

FOREIGN PATENT DOCUMENTS

EP 1 302 973 A2 4/2003

(Continued)

OTHER PUBLICATIONS

International Search Report and Written Opinion for International Application No. PCT/GB2009/001792 mailed Dec. 23, 2009.

*Primary Examiner* — Robert Kim
*Assistant Examiner* — Nicole Ippolito Rausch
(74) *Attorney, Agent, or Firm* — Squire, Sanders & Dempsey (US) LLP

(57) ABSTRACT

The present invention provides a mass spectrometer including an ion source for generating pre-cursor ions, ion fragmentation means for generating fragment ions from the pre-cursor ions, a reflectron for focusing the kinetic energy distribution of the ions, and an ion detector wherein the mass spectrometer also includes axial spatial distribution focusing means which in use acts on the ions after the ion fragmentation means and before the reflectron, the axial spatial distribution focusing means being operable to reduce the spatial distribution of the ions in the direction of the ion optical axis of the spectrometer. Suitably the axial spatial distribution focusing means comprising a cell with two electrodes 52, 54 which may be apertures or high transmission grids. A pulsed electrostatic field is generated by applying a high voltage pulse 60 to the first electrode 52 at the time when the pre-cursor ions of interest 56, 58 have just passed into the pulser 50. The second electrode 54 is maintained at 0V during this time.

32 Claims, 6 Drawing Sheets

U.S. PATENT DOCUMENTS

| | | | | |
|---|---|---|---|---|
| 2002/0158194 | A1 | 10/2002 | Vestal et al. | |
| 2004/0079873 | A1 | 4/2004 | Bateman et al. | |
| 2004/0094702 | A1* | 5/2004 | Clemmer | 250/283 |
| 2004/0094709 | A1* | 5/2004 | Bateman | 250/292 |
| 2006/0138316 | A1* | 6/2006 | Seydoux et al. | 250/282 |
| 2007/0029473 | A1* | 2/2007 | Verentchikov | 250/281 |
| 2008/0067365 | A1* | 3/2008 | Thakur et al. | 250/292 |
| 2009/0127455 | A1* | 5/2009 | Kim et al. | 250/288 |

FOREIGN PATENT DOCUMENTS

| | | |
|---|---|---|
| EP | 1 533 829 A2 | 5/2005 |
| WO | WO 00/18496 | 4/2000 |

* cited by examiner

METHOD AND APPARATUS FOR ION AXIAL SPATIAL DISTRIBUTION FOCUSING

CROSS-REFERENCE TO RELATED APPLICATION

This application claims the benefit of U.S. Provisional Application No. 61/129,879 filed on Jul. 25, 2008, which is hereby incorporated by reference.

BACKGROUND OF THE INVENTION

The present invention is concerned with methods and apparatus for mass spectrometers, especially TOF ("time-of-flight") mass spectrometers. In particular, the present invention relates to methods and apparatus for ion axial spatial distribution focusing.

TOF mass spectrometry is an analytical technique for measuring the mass to charge ratio of ions by accelerating ions and measuring their time-of-flight to a detector.

Two known methods of TOF mass spectrometry are matrix-assisted laser desorption/ionization TOF mass spectrometry ("MALDI TOF" mass spectrometry) and tandem TOF mass spectrometry ("TOF-MS/MS" mass spectrometry). Maldi TOF-MS and TOF-MS/MS are long established as methods of identifying macro-molecular compounds in biological systems for example.

In Maldi TOF-MS a laser pulse is focussed to a small spot ("laser spot") on a mixture of a sample of the biological material and a light-absorbing matrix on a sample plate so that a pulse of ions is produced.

This ion pulse is analysed and detected with a time-of-flight mass spectrometer, TOF-MS, so that the mass to charge ratio of the ions is measured.

In TOF-MS/MS mass spectrometry, ions undergo fragmentation before they are analysed and detected. The ions may be fragmented by meta-stable decay (post-source decay, PSD) or by collision induced dissociation (CID), for example. TOF-MS/MS is useful because it allows analysis of both precursor ions (non-fragmented ions) and product ions (fragmented ions). TOF-MS/MS mass spectrometry can be used in combination with MALDI TOF mass spectrometry. In other words, a MALDI ion source can be used in a mass spectrometer in which ions undergo fragmentation before they are detected.

In the ion source of the TOF mass spectrometer, at the time of extraction of the ions there are different distributions of the ions that characterise their initial direction, position and energy. For example, the range of radial position (distance from the ion optical axis) is determined by the spot size, as illustrated in FIG. 1. Thus, after desorption from the sample plate 1, ions 2, 4 are spaced from the ion optical axis 6 (the main axis of the spectrometer) by a distance R. In the case of a MALDI source the size of R is dictated by the diameter of the "laser spot", being the area from which ions are generated from the sample by the laser beam.

Each point in the ion source can generate a distribution in the initial direction or at an angle to the ion optical axis, as illustrated in FIG. 2. Thus, an ion 10 may possess a velocity having a radial component that is such as to cause them to travel away from the source at an angle θ to the ion optical axis 6. This characterises the expansion of the ion plume 12 outwards from the centre of the spot 14.

The ions are also produced with a range of initial energy or speed, as illustrated in FIG. 3. Thus, ions 20, 22 within the ion plume have different energy or velocity, such that, for example, the energy $E_1$ of ion 20 may be smaller than the energy $E_2$ of ion 22.

In the case of a Maldi sample the axial velocity distribution corresponds to a distribution in what is commonly known as the Jet velocity, typically around a few hundred $ms^{-1}$.

There is also a spatial distribution of ions in the axial direction normal to the sample surface, as illustrated in FIG. 4. This can be due to the different starting positions of ions because of sample topography and/or thickness. It can also be due to different starting times for ions coupled with the axial velocity. Thus, ions 30, 32 are separated in space in the axial direction (being parallel to the ion optical axis 6) by a distance Z.

Each of the distributions affects the performance of the TOF-MS (and TOF-MS/MS) and the result is measured by the width of the peak for a single mass to charge which in turn determines the mass resolution.

The size of the effects can be controlled by various means. For example, the radial spatial distribution is set by the size of the focussed laser spot and controlled by the collimation of the ion optical lenses in the mass spectrometer. Similarly, the effect of the angular distribution is also controlled by the lenses in the ion optics.

It is possible to compensate for either the axial spatial distribution or the velocity distribution with pulsed extraction by using the spatial distribution of the ions in combination with the pulsed electrostatic field to produce a space focus in the flight tube [Time-of-Flight Mass Spectrometer with Improved Resolution' W. C. Wiley and I. H. McLaren, Rev. Sci. Instrum., 26, 1150 (1955)]. The space focus is a point where all the ions in the velocity distribution come together at the same time. The space focus can be at the detector in the case of a linear time of flight or it can be the front focus of the ion mirror in a reflectron time of flight.

However, in using pulsed extraction from the ion source, it is well known that only one axial distribution can be focussed at a time. Either the initial axial spatial distribution or the initial axial velocity distribution can be brought to a space focus but not both distributions simultaneously.

In the case of orthogonal extraction of ions from a beam such as in electrospray TOF-MS, the axial spatial distribution is focussed by pulsed extraction whilst the axial velocity distribution for the time of flight is negligible being in the orthogonal direction.

In an ion source such as a MALDI or SIMS ion source, the ions are desorbed from the surface of a sample deposited on a plate by using pulsed extraction, which focuses the velocity distribution. This works on the basis that the size of the initial axial spatial distribution is much less than the spatial distribution of the ions produced by the velocity distribution during the delay time before pulsed extraction. However, this will only be the case if the sample is very thin (a few microns) and/or if the laser power is very close to the threshold for generating ions so that they originate only from the surface of the sample.

Thus, using an appropriate design of ion optics to collimate the ion beam coupled with a pulsed extraction ion source where the depth of desorbed sample is very thin and the laser power is very close to the threshold, it is possible to achieve very high mass resolutions for TOF-MS.

In TOF-MS the ions extracted from the ion source arrive at the detector intact so that the mass to charge ratio of the molecules from the sample is measured. If the ions are made to break up into smaller pieces or fragments, in the field free region, it is possible with a reflectron TOF-MS to measure the mass to charge ratio of the fragment ions and so carry out TOF-MS/MS. This technique, also known as tandem TOF or TOF/TOF allows the analysis of the structure of the molecules desorbed from the sample. So, for example, the amino-acid sequence of a peptide or protein sample can be determined from the TOF-MS/MS or fragment spectrum.

In TOF-MS/MS the ions fragment in the field free region of the TOF and do so either by the process of metastable decay and/or by collision with a neutral gas in a region of high pressure (CID).

When ions fragment in a field free region such as the flight tube or collision cell, where there are no external forces, the fragments continue with the velocity that is effectively the same as that of the parent (pre-cursor) ion. This in turn means that the energy of the fragment ion is reduced to the fraction of the parent ion energy in the ratio of the fragment mass to the parent mass. In other words, the following relationship applies, where $E_f$ is the kinetic energy of the fragment ion, $E_p$ is the kinetic energy of the parent ion, $m_f$ is the mass of the fragment ion and $m_p$ the mass of the parent ion:

$$E_f = E_p \cdot m_f / m_p$$

With a linear TOF-MS, there is no way of distinguishing between the fragment ions and the parent (pre-cursor) ions because they have the same velocity and therefore same flight time to the detector. However, as noted above, it is possible to distinguish between fragment ions by using a reflectron. A reflectron is effectively an energy analyser because the distance traveled by the ions into a reflectron is determined by the point at which the electrostatic potential is equal to the kinetic energy of the ions as they enter the reflectron. For fragment ions the distance traveled into the reflectron is a function of the energy which is determined by the ratio of the fragment mass to the parent mass. Since the flight time through the reflectron is dependent on the distance traveled into the reflectron, the time-of-flight of the fragment ion becomes a function of the ratio of the fragment mass to the parent mass.

In principle therefore any reflectron is capable of producing a TOF-MS/MS spectrum. However, because the parent ions have an initial energy distribution the fragment ions also have an energy distribution. The relationship between the nominal ion energy and the distance from the reflectron to the detector at which ions with differing initial energies are focussed, depends on the shape of the field or voltage distribution in the reflectron. The most common reflectrons have voltage distributions which vary linearly from the front to the back. Often (to make them more compact) there are two or more sections in one reflectron, each with different voltage gradients. For such linear field reflectrons the distance between the reflectron and the appropriate location of the detector also varies linearly with the nominal ion energy. It follows that the position of the detector for optimum mass resolution will vary linearly with fragment mass. However, in practice, because the detector is a fixed distance from the reflectron, the mass resolution for fragments falls rapidly as the mass reduces from the parent mass. The result is that a linear field reflectron cannot on its own produce a TOF-MS/MS spectrum where the complete fragment mass range is in focus and has good mass resolution.

Early instruments got around this problem by stepping the reflectron voltage and analysing a small segment of the fragment spectrum at a time. The major disadvantage of this was the need to collect multiple spectra and then 'stitch' them together which results in long experiment times and high sample consumption.

Recently, manufacturers have got around this problem by re-accelerating the ions after the point where fragmentation has taken place so that the range of fragment energy is effectively compressed into the narrow range for which good mass resolution is produce by the linear reflectron. So called TOF/TOF instruments [see for example U.S. Pat. No. 6,512,225 (Vestal) and U.S. Pat. No. 6,703,608 (Holle)] either start with, or slow down the ions to, a low energy typically 1 keV to 8 keV and then re-accelerate them by means of a second pulsed extraction region to a nominal energy around or greater than 20 keV. Such instruments have the disadvantages of being complex and expensive because of the additional pulsed high voltage fields required.

An alternative method is to use a reflectron where the potential distribution is non-linear so that the range of distance to the detector for different fragment ion mass is much smaller than for a linear reflectron. Such a reflectron is known as the curved field reflectron as described in U.S. Pat. No. 5,464,985 (Cotter). In this case it is possible to measure a complete TOF-MS/MS spectrum with good fragment ion mass resolution without re-acceleration of the fragment ions. Ions therefore have nominal energies of 20 keV from the source through to the reflectron. This method has the advantages of lower complexity and cost but also allows higher initial energies and therefore higher collision energies if using CID. However, one disadvantage is that the best mass resolution that can be achieved for the fragment ions is not as high as those instruments in which re-acceleration is used.

In the case of fragment ions produced by metastable decay (post-source decay, PSD), the production of the fragment ions relies on excess internal energy in the pre-cursor ions to cause the pre-cursor ions to fragment. The extra energy is produced in a MALDI ion source by increasing the laser fluence to well above the threshold required for ion generation.

In the case of collision induced dissociation (CID) the fragmentation is caused by high energy collisions with the neutral gas molecules. However, for efficient CID from a MALDI ion source, the laser power still has to be above the threshold level.

A consequence of the extra laser power required for TOF-MS/MS is that the mass resolution of the pre-cursor ions, and therefore also of the fragment ions, is much lower than for TOF-MS where the laser power is close to the threshold.

U.S. Pat. No. 5,739,529 (Laukien) describes a method for compensating the axial spatial distribution in reflectron TOF-MS. There, a pulsed electrostatic field is applied using electrodes located either in the reflectron or between the reflectron and the detector to focus the spatial distribution at the detector. This method provides for an improvement in mass resolution for TOF-MS ions over a very narrow mass range.

However, the present inventors have noted that this method is not suitable to compensate the spatial distribution for TOF-MS/MS because the fragment ions are separated in time by the reflectron so that only a narrow mass range of fragments could be focussed.

The present invention seeks to address this and other drawbacks associated with known methods of performing TOF-MS/MS described above.

SUMMARY OF THE INVENTION

The present inventors have noted that the observed reduction in mass resolution for TOF-MS/MS is due to the increase not only in the velocity and radial spatial distributions in the ion source but also the axial spatial distribution. The axial spatial distribution cannot be compensated for by pulsed extraction without losing the focussing of the initial velocity distribution and it cannot be compensated by the DC electrostatic fields as used for collimation of the ion beam through the TOF.

In particular, the present inventors have noted that the increased laser power needed for TOF-MS/MS leads to an increase in axial spatial distribution.

As is discussed below, the present invention provides a method and apparatus which improve the mass resolution of TOF-MS/MS by compensating for the effect of the axial spatial distribution of the ion source without affecting the other distributions such as the velocity distribution.

The present invention is particularly concerned with a method and apparatus for focussing the initial axial spatial distribution of ions in a reflectron time of flight mass spectrometer where the ions have already been extracted from the ion source using pulsed extraction to compensate for the initial velocity distribution.

At its most general, the present invention proposes that a pulsed electrostatic field can be applied to the ions at a point in the field free region where the velocity distribution comes to a spatial focus and the ions are axially dispersed due only to the initial axial spatial distribution. As will be clear from the discussion of the present invention herein, particular advantages can be achieved in combination with a curved-field reflectron such that high mass resolution is achieved for TOF-MS/MS.

This method for improving TOF-MS/MS mass resolution by pulsing an electrostatic field at the velocity distribution space focus is termed herein as "axial spatial distribution focussing" or "ASDF".

In a first aspect, the present invention provides a mass spectrometer including an ion source for generating pre-cursor ions, ion fragmentation means for generating fragment ions from the pre-cursor ions, a reflectron for focusing the kinetic energy distribution of the ions, and an ion detector wherein the mass spectrometer also includes axial spatial distribution focusing means which in use acts on the ions after the ion fragmentation means and before the reflectron, the axial spatial distribution focusing means being operable to reduce the spatial distribution of the ions in the direction of the ion optical axis of the spectrometer.

Preferably the axial spatial distribution focusing means is operable to reduce the axial spatial distribution of the ions such that fragment ions of the same mass arrive at the detector at substantially the same time as each other.

Preferably the axial spatial distribution focusing means include means for generating an axial electrostatic field whereby the electrostatic potential decreases away from the ion source in an axial direction.

Preferably the axial spatial distribution focusing means include means for generating an axial electrostatic field whereby the electrostatic potential increases away from the ion source in an axial direction.

Preferably the means for generating an axial electrostatic field includes a pair of electrodes spaced from each other in the axial direction. Suitably the electrodes are separated by a distance of 2 mm to 20 mm, preferably 2 mm to 10 mm, more preferably 2 mm to 5 mm.

Preferably the means for generating an axial electrostatic field is operable to apply a high voltage pulse to the electrode nearest to the ion source whilst maintaining the other electrode at approximately zero volts potential.

Suitably a voltage in the range 1 kV to 10 kV is applied to the electrode, more preferably 5 kV to 9 kV. These ranges are particularly preferred for a spacing between the electrodes of about 5 mm.

Preferably the means for generating an axial electrostatic field is operable to apply a high voltage pulse to the electrode furthest from the ion source whilst maintaining the other electrode at approximately zero volts potential.

Preferably the means for generating an axial electrostatic field is operable to apply the high voltage pulse at a time when the pre-cursor ions are at or have just passed the electrode nearest to the ion source.

Preferably the means for generating an axial electrostatic field is operable to apply the high voltage pulse at a time when the pre-cursor ions are between the pair of electrodes.

Preferably the means for generating an axial electrostatic field is operable to apply the high voltage pulse at a time when the pre-cursor ions are at or have just passed the electrode furthest from the ion source.

Preferably the means for generating an axial electrostatic field is operable to maintain the high voltage pulse until at least all the pre-cursor and fragment ions have passed through the axial spatial distribution focusing means.

Suitably the axial electrostatic field (and hence voltage pulse) is maintained for a period of 5 μs to 50 μs, more preferably 5 μs to 20 μs, and most preferably 10 μs to 15 μs. The duration of the axial electrostatic field is in practice selected based on the parent ion mass to charge ratio and the initial ion energy.

Suitably, the mass spectrometer includes control means to control the axial electrostatic field. Suitably the control means is a processor or computer. Preferably the control means coordinates (e.g. synchronises) the operation of the axial electric field with the generation and/or extraction of ions from the ion source such that the axial electrostatic field is switched on and off at the appropriate time with respect to the ions of interest. Suitably the control means provides (e.g. calculates and/or retrieves from a memory) the delay between generation and/or extraction of ions from the ion source and operation of the axial electrostatic field.

Preferably the mass spectrometer includes an electrode located between the axial spatial distribution focusing means and the reflectron, which electrode in use acts to terminate the axial electrostatic field produced by the axial spatial distribution focusing means.

Preferably the ion source is a pulsed extraction source which in use focuses the kinetic energy distribution of the pre-cursor ions so that fragment ions of the same mass arrive at the detector at substantially the same time.

Preferably the axial spatial distribution focusing means are located approximately at the space focus point for the velocity distribution produced by the ion source.

In practice, there is some tolerance in the respective locations of the space focus and the point where the ions are when the ASDF pulse is applied. Suitably the axial spatial distribution focusing means is located 10 mm or less from the space focus, preferably 5 mm or less, more preferably 3 mm or less and most preferably 1 mm or less.

Pulsed extraction of ions from the ion source can be used to produce a space focus where all the ions with different velocities in the ion source are brought to a single point at the same time. At this point, the ions will have an axial spatial distribution that is due only to the axial spatial distribution in the ion source. By applying a pulsed electrostatic field at this space focus, the present inventors have found that the ions acquire an additional velocity distribution that corresponds to the initial axial spatial distribution. This arrangement is particularly advantageous because there is no change in the original velocity distribution due to the pulsed electrostatic field because the ions are at the space focus. The strength of the electrostatic field can be adjusted so that the extra velocity distribution causes a second space focus at the detector. As this is the same position as the space focus for the velocity distribution, all the ions within both the initial velocity distribution and the initial axial spatial distribution arrive at the detector at the same time. As a result, the width of the peak for one nominal mass to charge is reduced and the mass resolution improved accordingly.

Preferably the reflectron is either a curved field reflectron or a quadratic field reflectron.

Where the reflectron is a curved field reflectron it is found that, not only are the peak widths reduced for the TOF-MS or pre-cursor ions but also the peak widths of the TOF-MS/MS or fragment ions produced from the focussed pre-cursor. This is because the fragment ions have the same nominal velocity as the pre-cursor ions and thus the same velocity distribution and the curved field reflectron is designed so that the space focus for the fragment ions is close to that of the pre-cursor ions.

Whilst curved field reflectrons are preferred, other reflectrons can be used to produce similar behaviour to the curved field reflectron in that the space focus at the detector for fragment ions is nominally the same as or very close to the that of the parent ions. Examples of these include field shapes that are substantially quadratic such as described by U.S. Pat. No. 4,625,112 (Yoshida) and U.S. Pat. No. 7,075,065 (Colburn). It would be possible to achieve results comparable with the curved-field reflectron by using ASDF with these types of reflectron. Similarly, any other type of reflectron capable of producing near coincident focuses for fragment ions and parent ions, could also be used with the ASDF method.

Preferably the ion fragmentation means is a collision-induced dissociation (CID) device.

Preferably the spectrometer includes an ion gate for selecting ions of a desired mass such that only ions of the desired mass pass through the ion gate, wherein the ion gate is located between the ion source and the axial spatial distribution focusing means.

Preferably the ion gate is operable in a first mode in which ions are prevented from passing through the ion gate and in a second mode in which ions are able to pass through the ion gate. Suitably the ion gate is switched between first and second modes so as to select pre-cursor ions of desired mass range. Preferably the switching and selection of pre-cursor ions is repeated so that multiple sets of precursor ions can be fragmented and analysed from the same ion pulse.

Thus, the present invention can be used to collect TOF-MS/MS spectra from more than one precursor at a time. This has the advantage that MS/MS data for multiple precursors can be acquired without having to repeat the TOF-MS/MS experiment for each individual precursor. This reduces both the total experiment time and sample consumption. As the pre-cursor ions (and their fragment ions with them) pass through the flight tube they separate according to their mass. The precursor ion mass is selected with a pulsed ion gate which is switched off for the time the precursor ions are within the gate. By switching the ion gate off multiple times it is possible to transmit multiple precursor ions (and their fragments) in order of mass, lowest first. When the lowest mass precursor ions reach the ASDF pulser it is pulsed on to focus the axial spatial distribution as appropriate to that precursor. The ASDF pulser is switched off again until the next precursor arrives at which point the pulser is switched on with electrostatic field appropriate to the new precursor. The TOF-MS/MS spectrum of each precursor is detected after being separated and focussed by the curved field reflectron.

In practice the TOF-MS/MS spectra from adjacent precursors may overlap in time. The degree of overlap will depend on the difference in flight time of the precursors. Where the overlap occurs could cause confusion of the fragments from different precursors. There are several possible ways to reduce the effect of overlap. Firstly, the separation in mass of the precursors can be set to a minimum value by selective switching of the ion gate so that the overlap between adjacent precursors is limited to a practical range of the fragment mass. Secondly, it is possible to distinguish low mass fragments of one precursor from the high mass fragments of the next through the difference in peak width or mass resolution. Thirdly, because the fragment calibration is valid only for fragments of the precursor from which they originated, it is possible to distinguish the correct fragments from the isotope spacing. This will be a particular value, not necessarily 1 Da, only when the fragments have the calibration for the appropriate precursor.

In a further aspect, the present invention provides a method for performing mass spectrometry including, in order, the following steps:

(a) generating pre-cursor ions from an ion source,
(b) generating fragment ions from the pre-cursor ions using ion fragmentation means,
(c) reducing the spatial distribution of some or all of the ions with respect to the axial direction of the spectrometer,
(d) focusing the kinetic energy distribution of the ions using a reflectron,
(e) detecting the ions at a detector.

Preferably the axial spatial distribution is reduced such that fragment ions of the same mass arrive at the detector at substantially the same time as each other.

Preferably the axial spatial distribution is reduced by generating an axial electrostatic field whereby the electrostatic potential decreases away from the ion source in an axial direction.

Preferably the axial spatial distribution is reduced by generating an axial electrostatic field whereby the electrostatic potential increases away from the ion source in an axial direction.

Preferably the axial electrostatic field is provided by a pair of electrodes spaced from each other in the axial direction and a high voltage pulse is applied to the electrode nearest to the ion source whilst maintaining the other electrode at approximately zero volts potential.

Preferably the axial electrostatic field is provided by a pair of electrodes spaced from each other in the axial direction and a high voltage pulse is applied to the electrode furthest from the ion source whilst maintaining the other electrode at approximately zero volts potential.

Preferably the high voltage pulse is applied at a time when the pre-cursor ions are at or have just passed the electrode nearest to the ion source.

Preferably the high voltage pulse is applied at a time when the pre-cursor ions are between the pair of electrodes.

Preferably the high voltage pulse is applied at a time when the pre-cursor ions are at or have just passed the electrode furthest from the ion source.

Preferably the high voltage pulse is maintained until at least all the pre-cursor and fragment ions have passed through the pair of electrodes.

Preferably the ion source is a pulsed extraction source which focuses the kinetic energy distribution of the pre-cursor ions so that fragment ions of the same mass arrive at the detector at substantially the same time.

Preferably the step of reducing the spatial distribution of some or all of the ions with respect to the axial direction of the spectrometer occurs at the space focus point for the velocity distribution produced by the ion source.

Preferably the method includes selecting ions of a desired mass range prior to reducing the spatial distribution in the axial direction.

Preferably the ions of desired mass range are selected by providing an ion selecting electrostatic field to prevent ions from passing along the spectrometer in an axial direction the detector and switching off the ion selecting electrostatic field to allow ions of the desired mass range to pass along the spectrometer in the axial direction.

Preferably the method includes the steps of (i) selecting a first set of ions having a first desired mass range and reducing the spatial distribution of the first set of ions in the axial direction of the spectrometer, and (ii) selecting a second set of ions having a second desired mass range and reducing the spatial distribution of the second set of ions in the axial direction of the spectrometer.

All of the optional and/or preferred features of any one aspect of this invention may be applied to any one of the other aspects. In particular, the optional and preferred features associated with the spectrometer aspect also apply to the method aspect, and vice versa. Any one aspect of this invention may be combined with any one or more of the other aspects.

Embodiments and experiments relating to the present invention are discussed below, with reference to the accompanying drawings in which:

Figure 1:
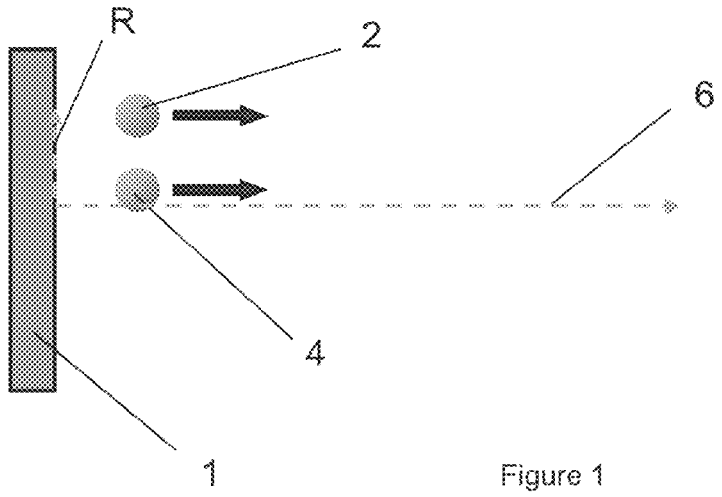
FIG. 1 shows the radial spatial distribution in the ion source.
Figure 2:
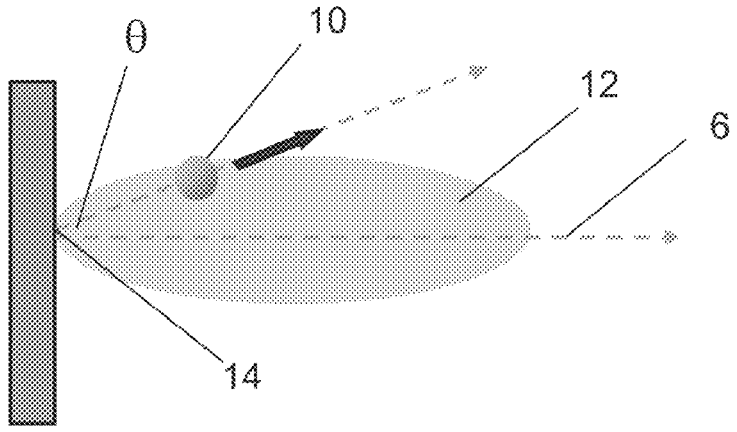
FIG. 2 shows the angular distribution in the ion source.
Figure 3:
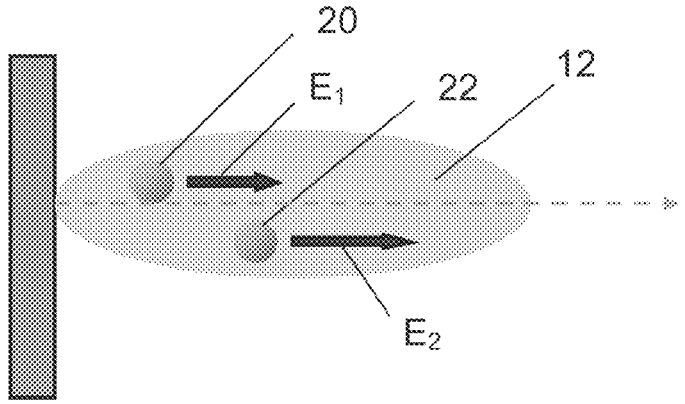
FIG. 3 shows the axial velocity distribution in the ion source.
Figure 4:
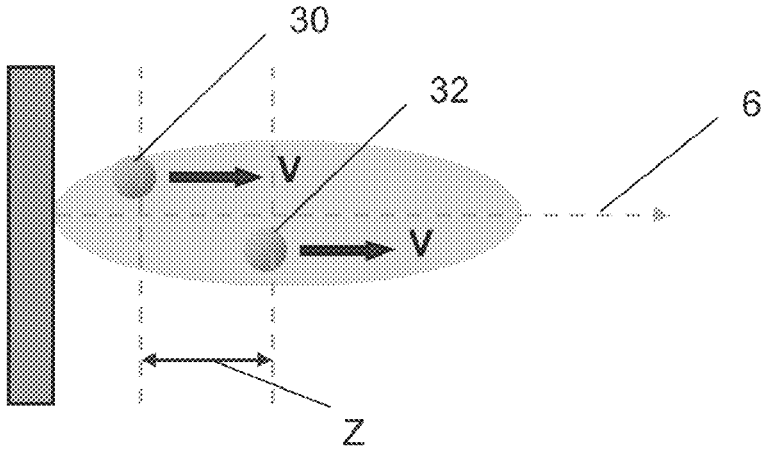
FIG. 4 shows the axial spatial distribution in the ion source.
Figure 5:
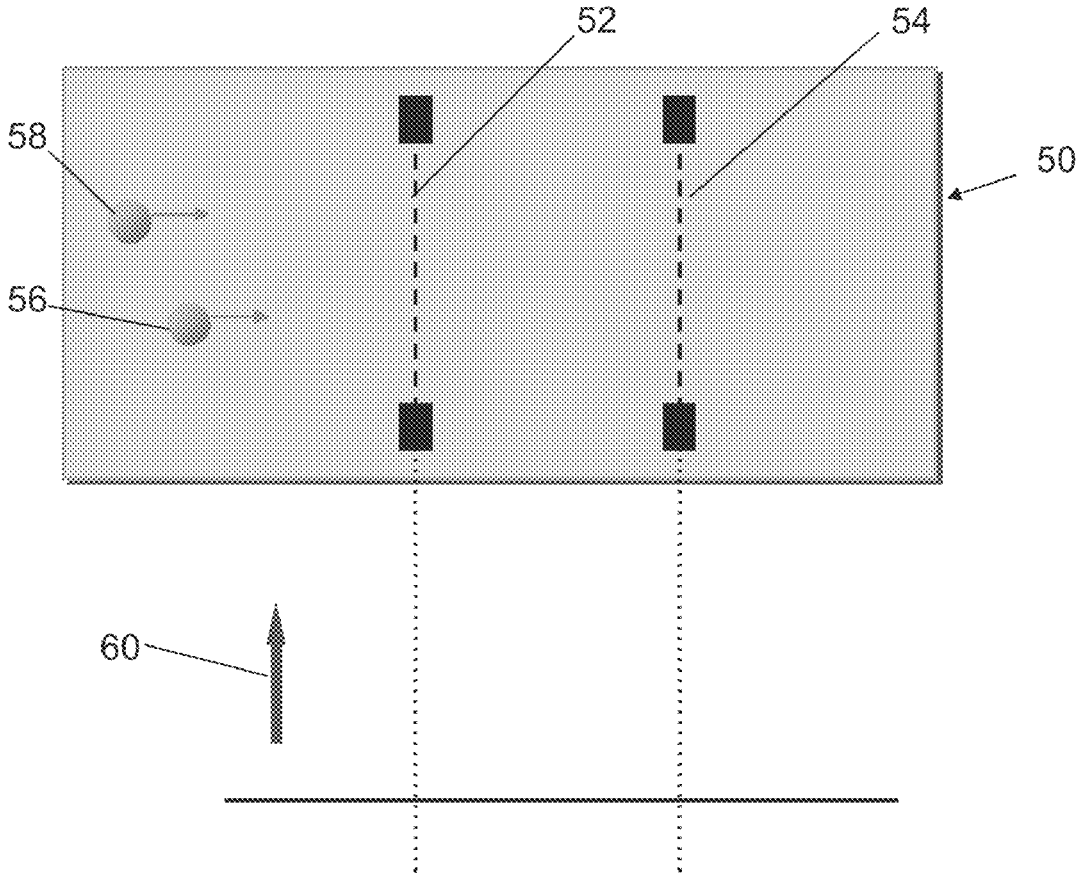
FIG. 5 shows a schematic of an ASDF pulser just before the pre-cursor and fragment ions enter.

In the embodiment shown in FIG. 5, the ASDF pulser 50 consists of a cell with two electrodes 52, 54 which may be apertures or high transmission grids. In this embodiment, the electrodes are spaced apart by a few mm, but other spacings are possible, for example 2 mm to 20 mm. Although not shown in FIG. 5, the pulser 50 is positioned at a point in the flight tube that is after the CID cell and after the point at which formation of fragment ions by meta-stable decay occurs but before the reflectron. As is preferred, the pulsed extraction at the ion source is arranged so that the space focus point for the initial velocity distribution is at or close to the position of the ASDF pulser. A pulsed electrostatic field is generated by applying a high voltage pulse 60 to the first electrode 52 at the time when the pre-cursor ions of interest 56, 58 have just passed into the pulser 50. The second electrode 54 is maintained at 0V during this time.

Figure 6:
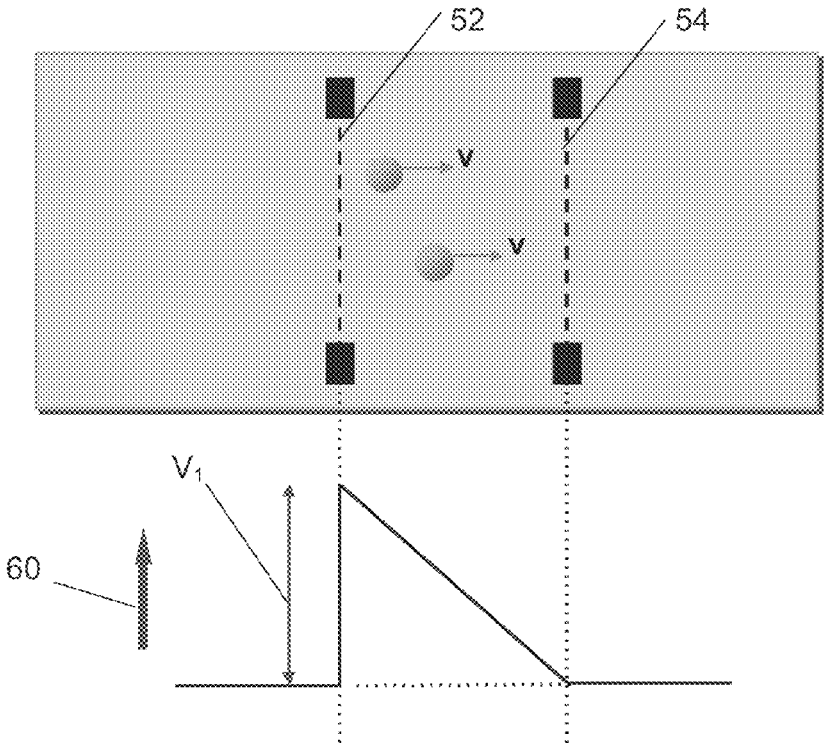
FIG. 6 shows a schematic of ASDF pulser just after the pre-cursor and fragment ions enter.

An appropriate electrostatic field sufficient to focus the initial axial spatial distribution is produced by adjusting the amplitude of the voltage pulse on the first electrode 52. Thus, as shown in FIG. 6, a potential $V_1$ is applied to the first electrode 52 when all of the ions of interest have passed into the cell (i.e. moved past the first electrode). Suitable voltages are in the range 1 kV to 10 kV, more preferably 5 kV to 9 kV. The voltage is maintained until at least the time when all the pre-cursor and fragment ions have passed through the pulser. Suitable pulse durations are 5 μs to 50 μs, 5 μs to 20 μs, and 10 μs to 15 μs. During this time, the second electrode 54 is maintained at 0V, so that the electrostatic potential within the pulser varies along the ion optical axis (i.e. in the axially direction). Thus, an axial electrostatic field is provided during the time that the ions of interest are within the pulser. As can be appreciated from FIG. 6, the electrostatic potential is higher closer to the first electrode and lower at increasing distances from the first electrode. This potential gradient between the electrodes means that ions closer to the first electrode will experience an acceleration for longer than ions closer to the second electrode. In this way, ions of interest arriving at the pulser later will experience a greater increase in velocity than those that arrived earlier. This causes the ions of interest to bunch together, thereby reducing or eliminating the initial axial distribution.

In this and other embodiments, the polarity of the applied potential can be positive or negative, so that the axial electrostatic field accelerates or decelerates the ions.

In a further embodiment, the arrangement is identical to that shown in FIGS. 5 and 6 except that the high voltage pulse is applied to the second electrode 54 whilst the first electrode is grounded. Furthermore, in one mode of operation, the timing of the pulse is such that the pulse is applied when the ions of interest are behind the second electrode 54 (e.g. located between the first and second electrodes). In a further mode of operation, the pulse is applied when the ions of interest are in front of the second electrode 54 (i.e. between the second electrode and the detector).

In the further embodiment wherein the pulse is applied to the second electrode, there is also a third, grounded, electrode located after the second electrode so that the axial electrostatic field is terminated properly.

Figure 7:
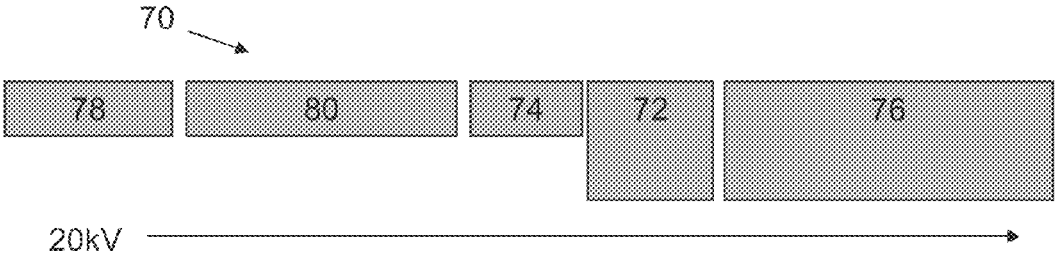
FIG. 7 shows a block schematic of an embodiment of the present invention.

A block diagram of the complete TOF-MS/MS instrument 70 is shown in FIG. 7. The ASDF pulser/cell 72 is located between the CID cell 74 and the reflectron 76. Thus, pre-cursor ions generated from MALDI source 78 have an initial axial spatial distribution, pass through linear TOF 80 and experience collision induced dissociation in CID cell 74 to produce fragment ions (which possess the initial axial spatial distribution of the pre-cursor ions). The fragment ions then pass through ASDF pulser/cell 72 where an axial electrostatic field is applied to the ions to impart a corrective velocity to the ions such that the ions are focused (that is, no longer have the initial axial spatial distribution) at the entrance to reflectron 82.

Figure 8:
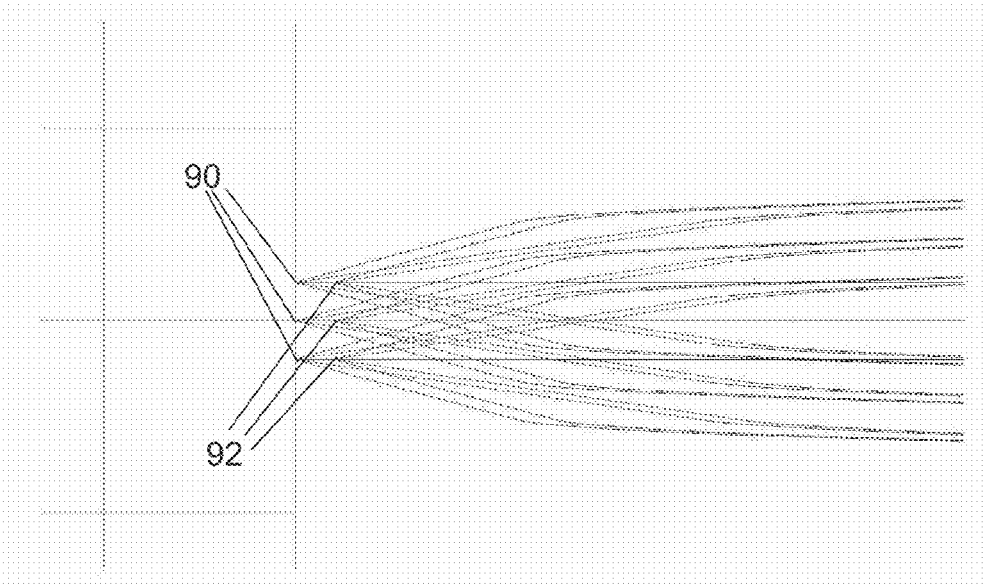
FIG. 8 shows initial ion trajectories for an ion model.

The effectiveness of the invention can be illustrated with ion trajectory modelling of a time of flight mass spectrometer (SIMION **3*d* V8). FIG. 8 shows the initial trajectories of parent (pre-cursor) ions from three points 90 on a sample surface corresponding to a radial spatial distribution of 100 μm, angular distribution of 30° and an axial velocity distribution of 350 to 650 $ms^{-1}$. Also included are ions 92** with the same initial trajectories but starting at a point 50 μm above the sample surface to represent the axial spatial distribution caused by increasing the laser power to produce MS/MS ions (and/or to represent ions generated from thick samples).

Figure 9:
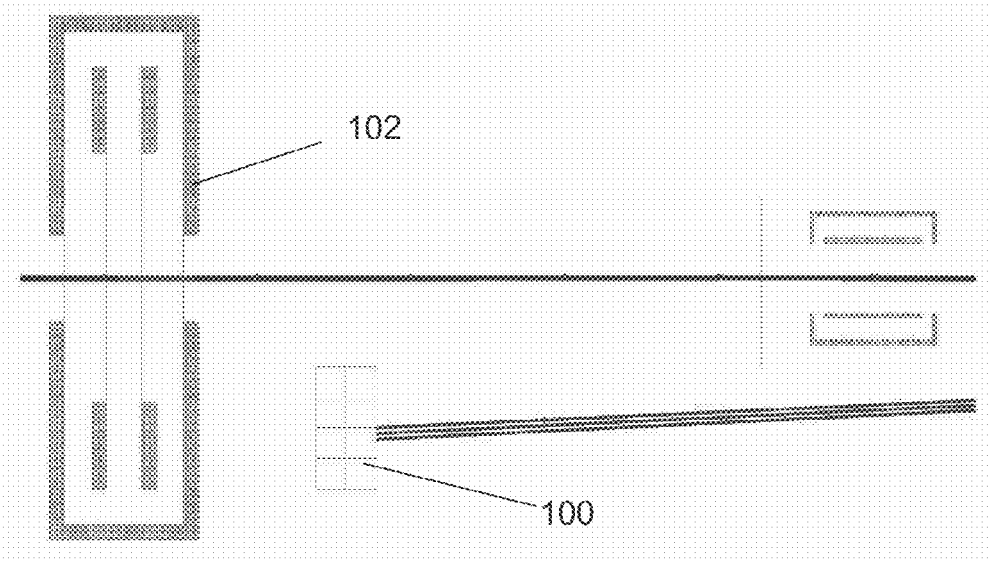
FIG. 9 shows ion trajectories through an ASDF pulser towards a curved field reflectron and back to a detector.

FIG. 9 shows the trajectory of the fragment ions with 50% of the parent mass at the detector 100 following pulsed extraction of the parent ions, CID to form fragment ions, ASDF pulsing (in ASDF cell 102) and the curved-field reflectron (not shown).

Figure 10:
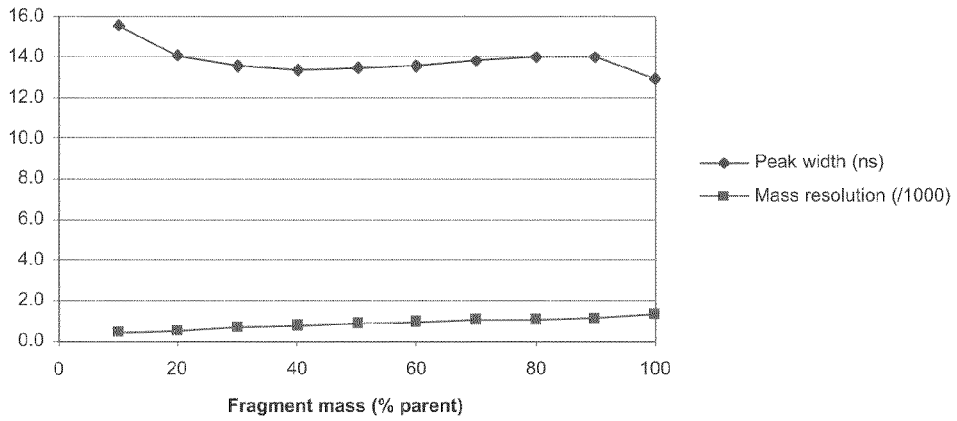
FIG. 10 shows the peak width and mass resolution of fragment ions of pre-cursor ACTH 18-39 (m/z 2466 Da) for 50 μm axial spatial distribution without ASDF.

The graph of FIG. 10 shows the peak width at the detector and the corresponding mass resolution for the different mass fragments of the peptide ACTH 18-39 with a nominal mass to charge ratio of 2466 Da but with the mass spectrometer set up for best mass resolution without using the ASDF pulser. It can be seen that the peak widths are typically around 14 ns corresponding to mass resolution for the fragment ions which is less than 2000. This mass resolution would not be good enough to resolve the isotope distribution of the fragment ions.

Figure 11:
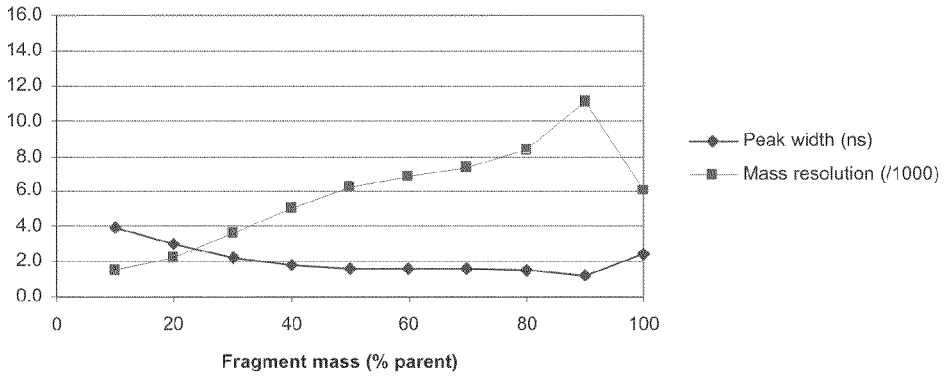
FIG. 11 shows peak width and mass resolution of fragment ions of pre-cursor ACTH 18-39 (m/z 2466 Da) for 50 μm axial spatial distribution with ASDF.

The graph of FIG. 11 shows the results for the same ions but in this case with the ion source pulsed extraction tuned to produce a space focus in the ASDF pulser and the ASDF pulser with 9 kV pulses applied to the first electrode (a grid, but the electrode could have another form, for example an aperture). The 9 kV pulse is applied to the first electrode after the fragment ions have entered the pulser. In this case the peak widths have been reduced to around 2 ns with fragment mass resolution up to a maximum of 10,000. This resolution corresponds to peak width for the fragments of about 0.25 Da which is enough to easily separate individual peaks in the fragment isotope distributions.

Figure 12:
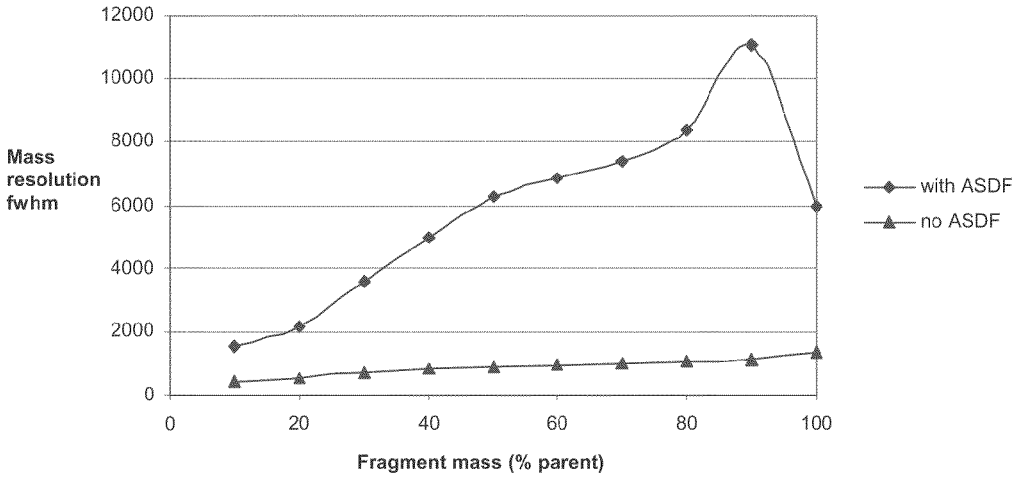
FIG. 12 shows a comparison of mass resolution for fragments of pre-cursor ACTH 18-39 (m/z 2466 Da) for an axial spatial distribution of 50 μm, with and without ASDF.

A direct comparison of the TOF-MS/MS mass resolution for this example, with and without ASDF, is shown in FIG. 12. Clearly, a considerable improvement in the mass resolution is achieved for the entire range of fragment masses.

I claim:

1. A mass spectrometer including
an ion source for generating pre-cursor ions,
ion fragmentation means for generating fragment ions from the pre-cursor ions,
a reflectron for focusing the kinetic energy distribution of the fragment ions, and
an ion detector,
wherein the mass spectrometer also includes
axial spatial distribution focusing means which in use acts on the ions after the ion fragmentation means and before the reflectron,
the axial spatial distribution focusing means including means for generating an axial electrostatic field that is operable to reduce the spatial distribution of the ions in the direction of the ion optical axis of the spectrometer.

2. A mass spectrometer according to claim 1 wherein the axial spatial distribution focusing means is operable to reduce the axial spatial distribution of the ions such that fragment ions of the same mass arrive at the detector at substantially the same time as each other.

3. A mass spectrometer according to claim 1 wherein the electrostatic potential decreases away from the ion source in an axial direction or increases away from the ion source in an axial direction.

4. A mass spectrometer according to claim 3, wherein the means for generating an axial electrostatic field includes a pair of electrodes spaced from each other in the axial direction.

5. A mass spectrometer according to claim 4 wherein the means for generating an axial electrostatic field is operable to apply a high voltage pulse to the electrode nearest to the ion source whilst maintaining the other electrode at approximately zero volts potential.

6. A mass spectrometer according to claim 5, wherein the means for generating an axial electrostatic field is operable to maintain the high voltage pulse until at least all the pre-cursor and fragment ions have passed through the axial spatial distribution focusing means.

7. A mass spectrometer according to claim 4 wherein the means for generating an axial electrostatic field is operable to apply a high voltage pulse to the electrode furthest from the ion source whilst maintaining the other electrode at approximately zero volts potential.

8. A mass spectrometer according to claim 7, wherein the means for generating an axial electrostatic field is operable to apply the high voltage pulse at a time when the pre-cursor ions are between the pair of electrodes.

9. A mass spectrometer according to claim 7, wherein the means for generating an axial electrostatic field is operable to apply the high voltage pulse at a time when the pre-cursor ions are at or have just passed the electrode furthest from the ion source.

10. A mass spectrometer according to claim 1, wherein the mass spectrometer includes an electrode located between the axial spatial distribution focusing means and the reflectron, which electrode in use acts to terminate the axial electrostatic field produced by the axial spatial distribution focusing means.

11. A mass spectrometer according to claim 1 wherein the axial spatial distribution focusing means are located approximately at the space focus point for the velocity distribution produced by the ion source.

12. A mass spectrometer according to claim 1 wherein the reflectron is either a curved field reflectron or a quadratic field reflectron.

13. A mass spectrometer according to claim 1 wherein the ion fragmentation means is a collision-induced dissociation (CID) device.

14. A mass spectrometer according to claim 1 wherein the spectrometer includes an ion gate for selecting ions of a desired mass such that only ions of the desired mass pass through the ion gate, wherein the ion gate is located between the ion source and the axial spatial distribution focusing means.

15. A mass spectrometer according to claim 14, wherein the ion gate is operable in a first mode in which ions are prevented from passing through the ion gate and in a second mode in which ions are able to pass through the ion gate.

16. A mass spectrometer including
an ion source for generating pre-cursor ions,
ion fragmentation means for generating fragment ions from the pre-cursor ions,
a reflectron for focusing the kinetic energy distribution of the fragment ions, and
an ion detector,
wherein the mass spectrometer also includes
axial spatial distribution focusing means which in use acts on the ions after the ion fragmentation means and before the reflectron,
the axial spatial distribution focusing means including means for generating an axial electrostatic field that is operable to reduce the spatial distribution of the ions in the direction of the ion optical axis of the spectrometer, wherein the electrostatic potential decreases away from the ion source in an axial direction or increases away from the ion source in an axial direction, wherein the means for generating an axial electrostatic field includes a pair of electrodes spaced from each other in the axial direction, wherein the means for generating an axial electrostatic field is operable to apply a high voltage pulse to the electrode nearest to the ion source whilst maintaining the other electrode at approximately zero volts potential, and wherein the means for generating an axial electrostatic field is operable to apply the high voltage pulse at a time when the pre-cursor ions are at or have just passed the electrode nearest to the ion source.

17. A mass spectrometer including an ion source for generating pre-cursor ions, ion fragmentation means for generating fragment ions from the pre-cursor ions, a reflectron for focusing the kinetic energy distribution of the fragment ions, and an ion detector, wherein the mass spectrometer also includes axial spatial distribution focusing means which in use acts on the ions after the ion fragmentation means and before the reflectron, the axial spatial distribution focusing means including means for generating an axial electrostatic field that is operable to reduce the spatial distribution of the ions in the direction of the ion optical axis of the spectrometer, wherein the ion source is a pulsed extraction source which in use focuses the kinetic energy distribution of the pre-cursor ions so that fragment ions of the same mass arrive at the detector at substantially the same time.

18. A method for performing mass spectrometry including, in order, the following steps:

(a) generating pre-cursor ions from an ion source, (b) generating fragment ions from the pre-cursor ions using ion fragmentation means, (c) reducing the spatial distribution of some or all of the ions with respect to the axial direction of the spectrometer by generating an axial electrostatic field, (d) focusing the kinetic energy distribution of the fragment ions using a reflectron, (e) detecting the ions at a detector.

19. A method according to claim 18 wherein the axial spatial distribution is reduced such that fragment ions of the same mass arrive at the detector at substantially the same time as each other.

20. A method according to claim 18 wherein the electrostatic potential decreases away from the ion source in an axial direction or increases away from the ion source in an axial direction.

21. A method according to claim 20 wherein the axial electrostatic field is provided by a pair of electrodes spaced from each other in the axial direction and a high voltage pulse is applied to the electrode nearest to the ion source whilst maintaining the other electrode at approximately zero volts potential.

22. A method according to claim 21, wherein the high voltage pulse is maintained until at least all the pre-cursor and fragment ions have passed through the pair of electrodes.

23. A method according to claim 20 wherein the axial electrostatic field is provided by a pair of electrodes spaced from each other in the axial direction and a high voltage pulse is applied to the electrode furthest from the ion source whilst maintaining the other electrode at approximately zero volts potential.

24. A method according to claim 23, wherein the high voltage pulse is applied at a time when the pre-cursor ions are between the pair of electrodes.

25. A method according to claim 23, wherein the high voltage pulse is applied at a time when the pre-cursor ions are at or have just passed the electrode furthest from the ion source.

26. A method according to claim 18 wherein the step of reducing the spatial distribution of some or all of the ions with respect to the axial direction of the spectrometer occurs at the space focus point for the velocity distribution produced by the ion source.

27. A method according to claim 18 wherein the method includes selecting ions of a desired mass range prior to reducing the spatial distribution in the axial direction.

28. A method according to claim 27 wherein the ions of desired mass range are selected by providing an ion selecting electrostatic field to prevent ions from passing along the spectrometer in an axial direction the detector and switching off the ion selecting electrostatic field to allow ions of the desired mass range to pass along the spectrometer in the axial direction.

29. A method according to claim 27 wherein the method includes the steps of (i) selecting a first set of ions having a first desired mass range and reducing the spatial distribution of the first set of ions in the axial direction of the spectrometer, and (ii) selecting a second set of ions having a second desired mass range and reducing the spatial distribution of the second set of ions in the axial direction of the spectrometer.

30. A method for performing mass spectrometry including, in order, the following steps:

(a) generating pre-cursor ions from an ion source, (b) generating fragment ions from the pre-cursor ions using ion fragmentation means, (c) reducing the spatial distribution of some or all of the ions with respect to the axial direction of the spectrometer by generating an axial electrostatic field, (d) focusing the kinetic energy distribution of the fragment ions using a reflectron, (e) detecting the ions at a detector, wherein the electrostatic potential decreases away from the ion source in an axial direction or increases away from the ion source in an axial direction, wherein the axial electrostatic field is provided by a pair of electrodes spaced from each other in the axial direction and a high voltage pulse is applied to the electrode nearest to the ion source whilst maintaining the other electrode at approximately zero volts potential, and wherein the high voltage pulse is applied at a time when the pre-cursor ions are at or have just passed the electrode nearest to the ion source.

31. A method for performing mass spectrometry including, in order, the following steps:

(a) generating pre-cursor ions from an ion source, (b) generating fragment ions from the pre-cursor ions using ion fragmentation means, (c) reducing the spatial distribution of some or all of the ions with respect to the axial direction of the spectrometer by generating an axial electrostatic field, (d) focusing the kinetic energy distribution of the fragment ions using a reflectron, (e) detecting the ions at a detector, wherein the ion source is a pulsed extraction source which focuses the kinetic energy distribution of the pre-cursor ions so that fragment ions of the same mass arrive at the detector at substantially the same time.

32. A mass spectrometer including:

an ion source for generating pre-cursor ions;

ion fragmentation means for generating fragment ions from the pre-cursor ions;

a reflectron for focusing the kinetic energy distribution of the fragment ions; and an ion detector, wherein the mass spectrometer also includes axial spatial distribution focusing means which in use acts on the ions after the ion fragmentation means and before the reflectron, the axial spatial distribution focusing means including means for generating an axial electrostatic field whereby the electrostatic potential decreases away from the ion source in an axial direction or increases away from the ion source in an axial direction, and whereby the means for generating an axial electrostatic field is operable to reduce the spatial distribution of the ions in the direction of the ion optical axis of the spectrometer.

* * * * *